US009637878B2

(12) United States Patent
Morgan

(10) Patent No.: US 9,637,878 B2
(45) Date of Patent: May 2, 2017

(54) HAZARD ALERT ASSEMBLY

(71) Applicant: Keith Morgan, Markham (CA)

(72) Inventor: Keith Morgan, Markham (CA)

( * ) Notice: Subject to any disclaimer, the term of this patent is extended or adjusted under 35 U.S.C. 154(b) by 299 days.

(21) Appl. No.: 14/490,009

(22) Filed: Sep. 18, 2014

(65) Prior Publication Data

US 2016/0083915 A1 Mar. 24, 2016

(51) Int. Cl.
*E01F 9/688* (2016.01)
*G09F 13/16* (2006.01)
*G09F 15/00* (2006.01)

(52) U.S. Cl.
CPC ..... *E01F 9/688* (2016.02); *G09F 13/16* (2013.01); *G09F 15/0062* (2013.01)

(58) Field of Classification Search
CPC ... B60Q 7/00; B60Q 7/005; E01F 9/00; E01F 9/012; E01F 9/654; E01F 9/688; G09F 13/16; G09F 15/0062
USPC ..... 116/63 P, 63 T, 63 R, 63 C; 102/343; 40/612, 903; 404/6, 9, 10
See application file for complete search history.

(56) References Cited

U.S. PATENT DOCUMENTS

| | | | | |
|---|---|---|---|---|
| 3,593,681 | A * | 7/1971 | Sernovitz | B60Q 7/005 116/63 P |
| 3,742,897 | A | 7/1973 | Meek et al. | |
| 4,176,485 | A | 12/1979 | Terris | |
| 4,430,638 | A | 2/1984 | Parker | |
| 4,801,918 | A | 1/1989 | Buckingham et al. | |
| D305,037 | S | 12/1989 | Gromer, Jr. | |
| D409,515 | S | 5/1999 | Chen | |
| 6,543,165 | B2 | 4/2003 | Youseph et al. | |
| 6,734,792 | B1 * | 5/2004 | McElveen | B60Q 1/2661 340/321 |
| 6,948,446 | B2 | 9/2005 | Greves | |
| 2013/0087030 | A1 | 4/2013 | Jones | |

* cited by examiner

*Primary Examiner* — Laura Martin
*Assistant Examiner* — Irving A Campbell

(57) ABSTRACT

A hazard alert assembly for alerting an observer to a hazard includes a base structured to retain a flare on a support surface so the flare is visible to an observer. A frame is coupled to the base so the frame may be visible to the observer. The frame alerts the observer to a hazard. An arrow is coupled to the frame so the arrow is may indicate a direction the observer should travel to avoid the hazard.

8 Claims, 5 Drawing Sheets

HAZARD ALERT ASSEMBLY

BACKGROUND OF THE DISCLOSURE

Field of the Disclosure

The disclosure relates to alert devices and more particularly pertains to a new alert device for alerting an observer to a hazard.

SUMMARY OF THE DISCLOSURE

An embodiment of the disclosure meets the needs presented above by generally comprising a base structured to retain a flare on a support surface so the flare is visible to an observer. A frame is coupled to the base so the frame may be visible to the observer. The frame alerts the observer to a hazard. An arrow is coupled to the frame so the arrow is may indicate a direction the observer should travel to avoid the hazard.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
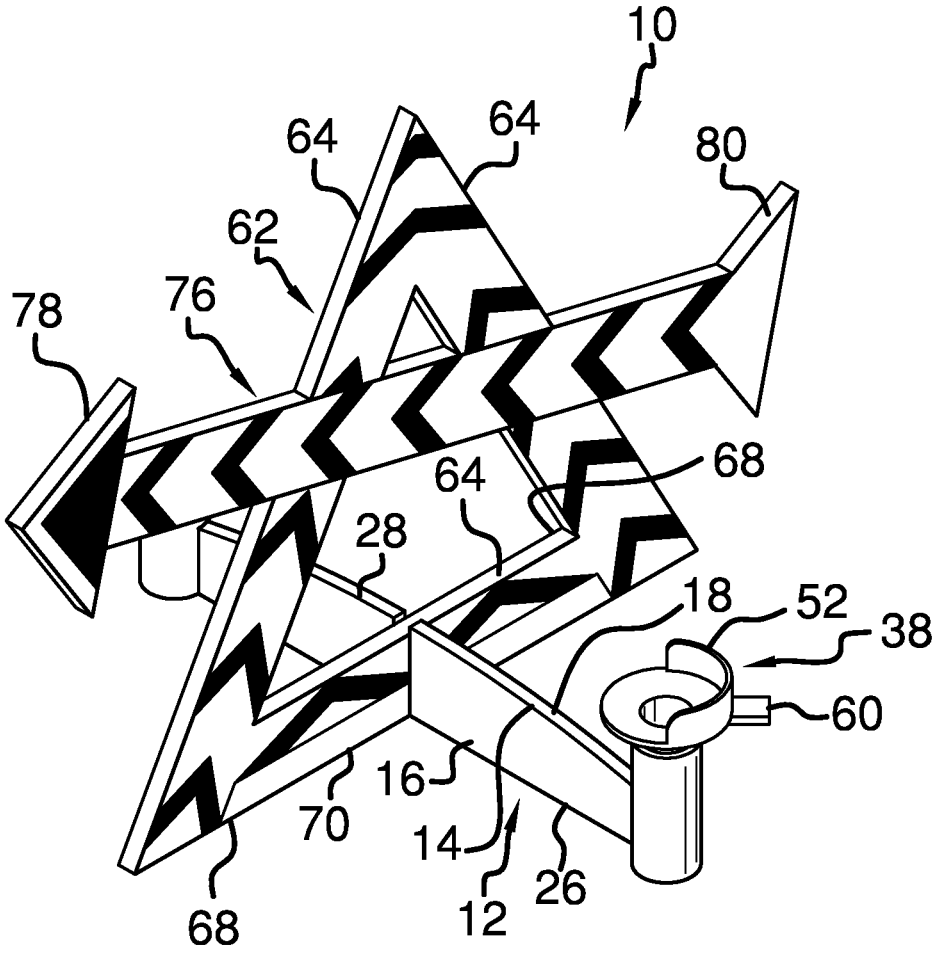
FIG. 1 is a perspective view of a hazard alert assembly according to an embodiment of the disclosure.
Figure 2:
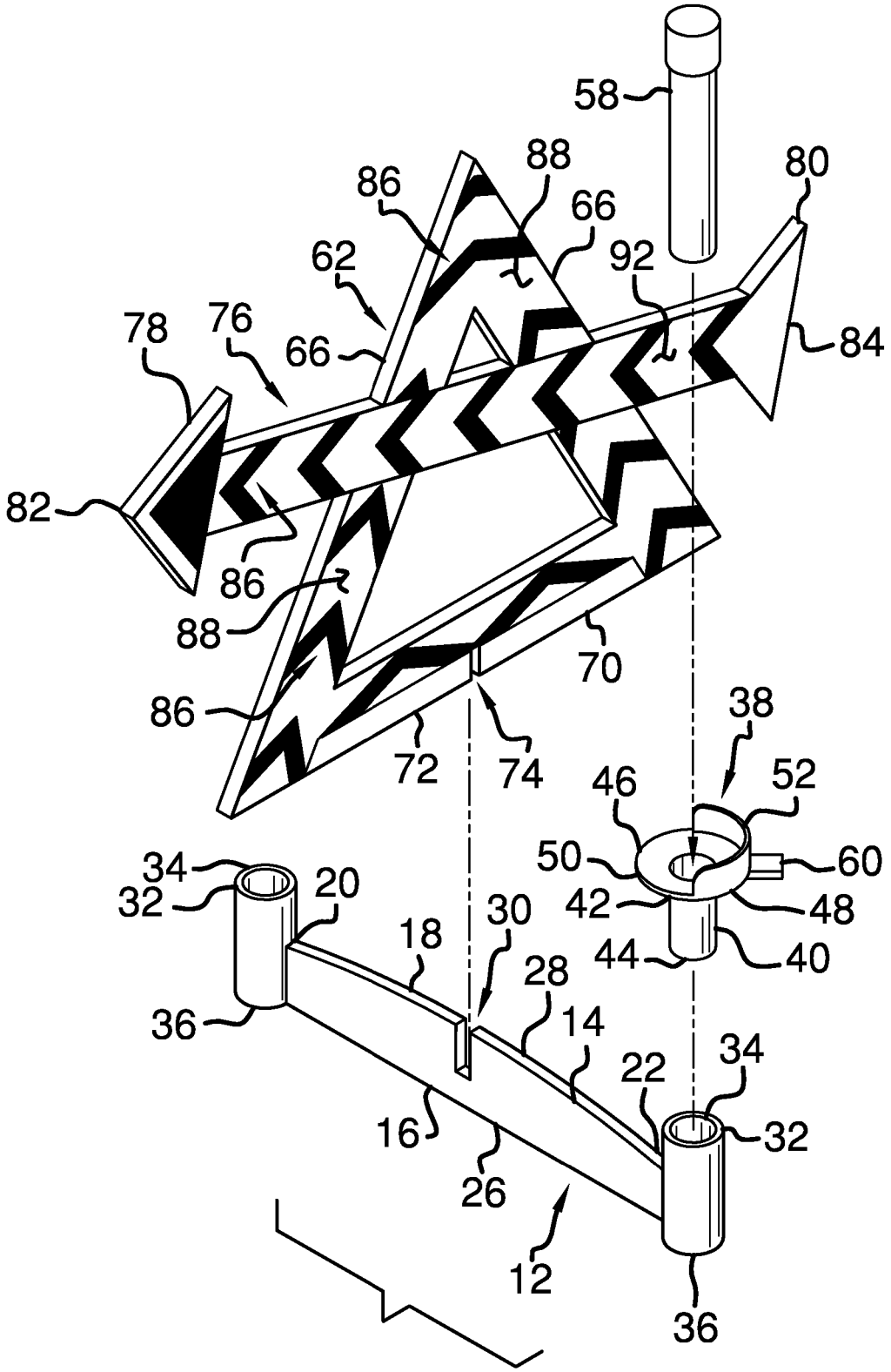
FIG. 2 is an exploded perspective view of an embodiment of the disclosure.
Figure 3:
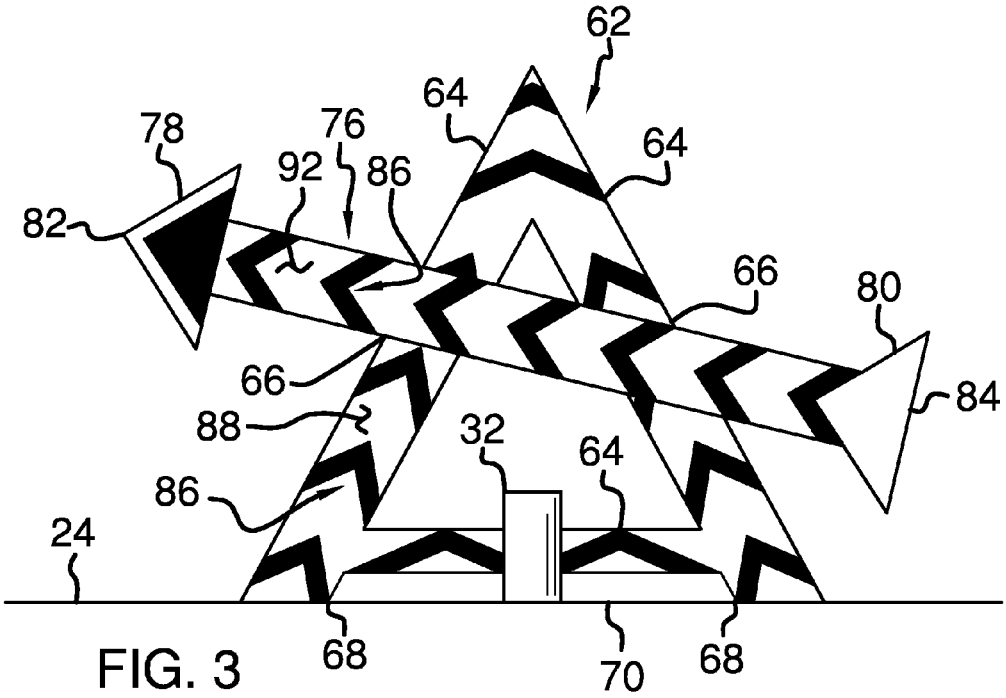
FIG. 3 is a front view of an embodiment of the disclosure.
Figure 4:
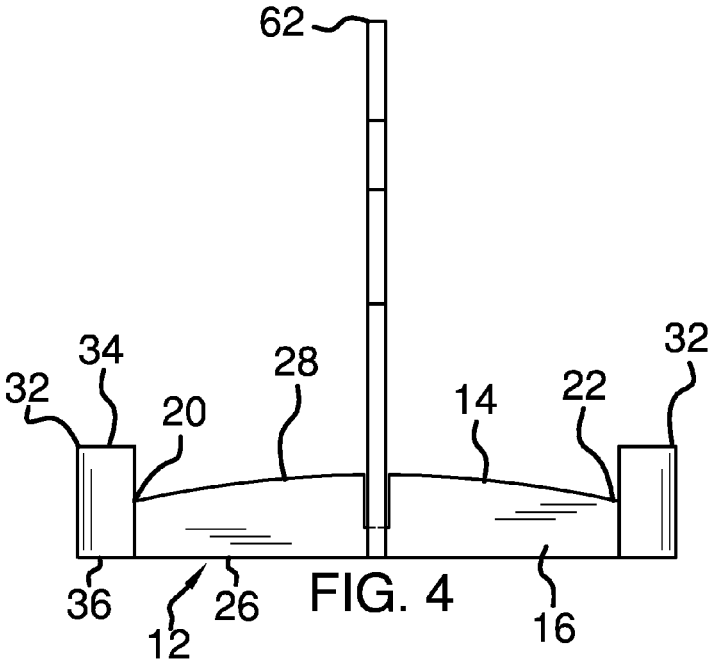
FIG. 4 is a left side view of an embodiment of the disclosure.
Figure 5:
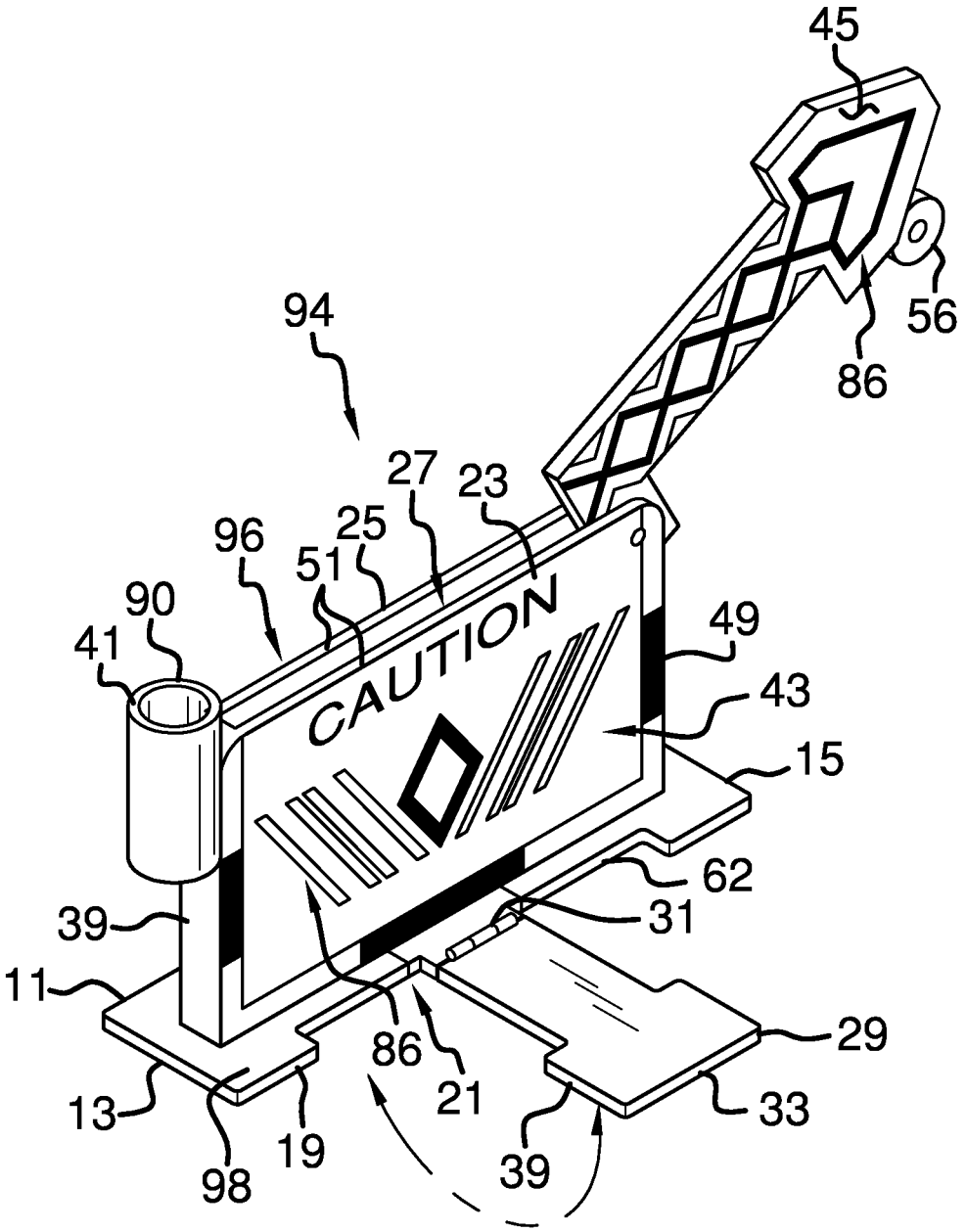
FIG. 5 is a perspective view of an alternative embodiment of the disclosure.
Figure 6:
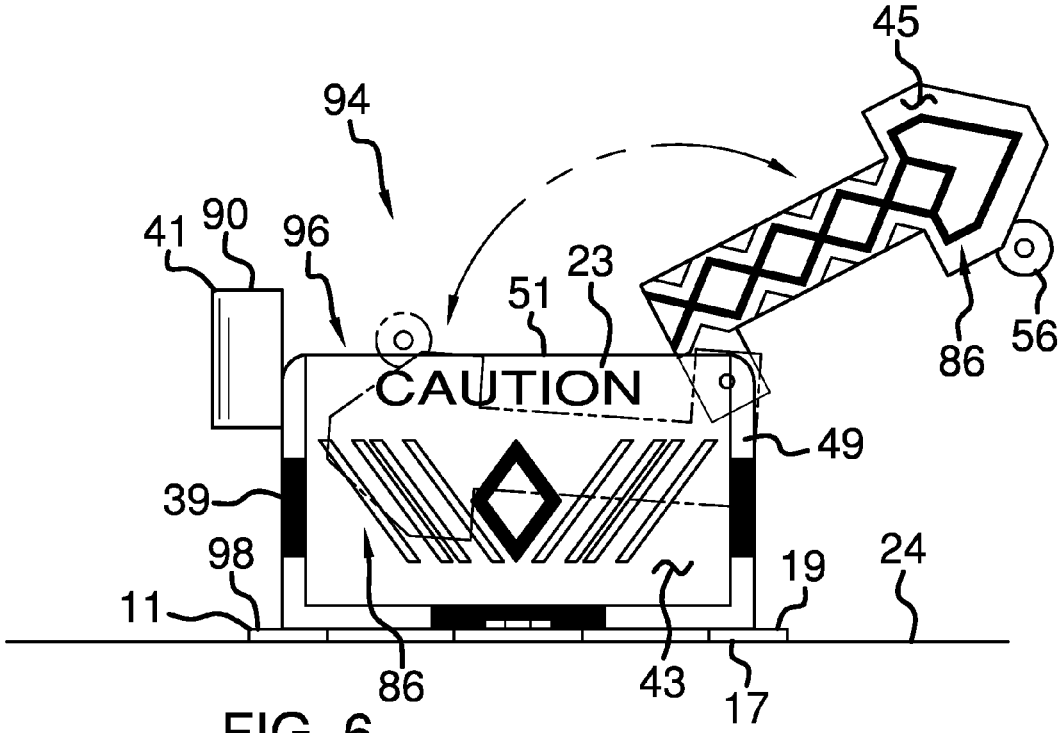
FIG. 6 is a front side view of an alternative embodiment of the disclosure.
Figure 7:
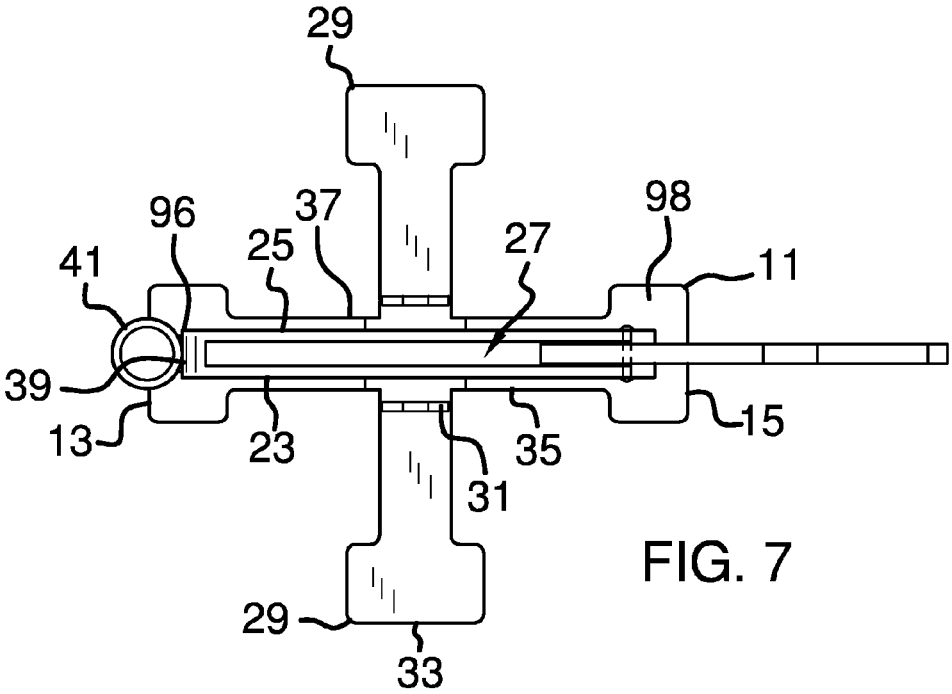
FIG. 7 is a top view of an alternative embodiment of the disclosure.

With reference now to the drawings, and in particular to FIGS. 1 through 7 thereof, a new alert device embodying the principles and concepts of an embodiment of the disclosure and generally designated by the reference numeral 10 will be described.

As best illustrated in FIGS. 1 through 7, the hazard alert assembly 10 generally comprises a base 12. The base 12 has a perimeter edge 14 extending between each of a front side 16 and a back side 18 of the base 12. Moreover, the base 12 has a first end 20 and a second end 22. The base 12 is elongated between the first 20 and second 22 ends.

The base 12 is positionable on a support surface 24 so a bottom side 26 of the perimeter edge 14 of the base 12 abuts the support surface 24. The support surface 24 may be ground. A top side 28 of the perimeter edge 14 of the base 12 has a first groove 30 extending downwardly therein. The first groove 30 is centrally positioned on the base 12.

A pair of tubes 32 is provided. Each of the tubes 32 has a top end 34 and a bottom end 36. The top end 34 of the tubes 32 is open. Additionally, the tubes 32 are each coupled to an associated one of the first 20 and second 22 ends of the base 12. The top ends 34 of the tubes 32 are directed upwardly from a top side 28 of the perimeter edge 14 of the base 12.

A holder 38 is provided. The holder 38 includes a sleeve 40. The sleeve 40 has an uppermost end 42 and a bottommost end 44. The holder 38 additionally includes a plate 46. The uppermost end 42 of the sleeve 40 is coupled to a bottom surface 48 of the plate 46. Additionally, the sleeve 40 is centrally positioned on the bottom surface 48 of the plate 46.

An exterior edge 50 of the plate 46 is curved so the plate 46 has a disk shape. A rim 52 is coupled to and extends upwardly from a top surface 54 of the plate 46. The rim 52 is coextensive with the exterior edge 50 of the plate 46. Additionally, the rim 52 extends around less than an entire circumference of the plate 46. The sleeve 40 is insertably positionable within a selected one the tubes 32 so the bottom surface 48 of the plate 46 abuts the top end 34 of the selected tubes 32.

A flare 58 is positionable on the top surface 54 of the plate 46 after the holder 38 is positioned within the selected one of the tubes 32. The rim 52 retains the flare 58 in the holder 38. The holder 38 is positioned in the selected tubes 32 so the flare 58 is visible to an observer. The flare 58 may be a traffic flare of any conventional design. A tab 60 is coupled to and extends outwardly from the exterior edge 50 of the plate 46. The tab 60 may be gripped.

A frame 62 is provided. The frame 62 comprises a plurality of arms 64. A pair of vertical ones 66 of the arms 64 is coupled to and extends upwardly from opposite ends 68 of a horizontal one 70 of the arms 64. The pair of vertical arms 66 intersects at a point so the frame 62 has a triangular shape. A lower side 72 of the horizontal arm 70 has a second groove 74 extending upwardly therein. The second groove 74 is centrally positioned on the horizontal arm 70.

The second groove 74 on the horizontal arm 70 of the frame 62 removably engages the first groove 30 in the base 12. Moreover, the horizontal arm 70 of the frame 62 is oriented transversely to the base 12. The vertical arms 66 of the frame 62 extend upwardly from the base 12 so the frame 62 may be visible to the observer. The frame 62 alerts the observer to a hazard. The hazard may be a traffic hazard.

An arrow 76 is provided. The arrow 76 has a primary end 78 and a secondary end 80. Additionally, the arrow 76 is elongated between the primary 78 and secondary 80 ends. The arrow 76 is structured so the primary end 78 of the arrow 76 defines a point 82 of the arrow 76 and the secondary end 80 of the arrow defines a tail 84 of the arrow 76.

The arrow 76 is coupled to the frame 62 so the arrow 76 intersects each of the vertical arms 66 of the frame 62. The primary 78 and secondary 80 ends of the arrow 76 are positioned proximate an associated one of the vertical arms 66 of the frame 62. Additionally, the arrow 76 is positioned closer to the intersection of the vertical arms 66 of the frame 62 than the horizontal arm 70 of the frame 62. The arrow 76 is oriented at an angle with respect to the horizontal arm 70 of the frame 62. Moreover, the primary end 78 of the arrow 76 is spaced further from the horizontal arm 70 of the frame 62 than the secondary end 80 of the arrow 76.

Indicia 86 are printed on a front surface 88 of the frame 62. The indicia 86 comprise a plurality of chevrons pointing toward the intersection of the vertical arms 66 of the frame 62. Indicia 86 are printed on a forward surface 92 of the arrow 76. The indicia 86 comprise a plurality of chevrons pointing toward the primary end 78 of the arrow 76. The arrow 76 and the frame 62 may be comprised of a reflective material so the arrow 76 and the frame 62 are highly visible to the observer.

In an alternative embodiment 94, a panel 96 is coupled to and extends upwardly from a top side 98 of a platform 11. The panel 96 extends between a first 13 end and a second end 15 of the platform 11. The platform 11 is positionable on the support surface 24 so a bottom side 17 of the platform 11 abuts the support surface 24. An extraneous edge 19 of the platform 11 extends outwardly proximate each of the first 13 and second 15 ends of the platform 11 with respect to a middle 21 of the platform 11. The platform 11 may have an I-shape Each of a forward side 23 and a rearward side 25 of the panel 96 are spaced apart to define a channel 27 between the forward 23 and rearward 25 sides of the panel 96.

A pair of legs 29 is provided. The legs 29 have a coupled end 31 and a free end 33. The coupled end 31 of the legs 29 is hingedly coupled to an associated one of a front side 35 and a back side 37 of the extraneous edge 19 of the platform 11. An outer edge 39 of the legs 29 extends outwardly proximate the free end 33 of the legs 29 with respect to the coupled end 31 of the legs 29. The legs 29 may have a T-shape. Each of the legs 29 is positionable in a deployed position having the legs 29 extending away from the associated front 35 and back 37 sides of the platform 11. The legs 29 keep the platform 11 stable on the support surface 24.

The secondary end 80 of the arrow 76 is hingedly coupled to the forward 23 and rearward 25 sides of the panel 96. The arrow 76 is positioned within the channel 27 between the forward 23 and rearward 25 sides of the panel 96. A knob 56 is coupled to a lowermost edge 47 of the arrow 76. The knob 56 is positioned proximate the primary end 78 of the arrow 76. The arrow 76 is positioned adjacent to a first lateral side 49 of the panel 96.

The arrow 76 is positionable in a stored position that has the arrow 76 concealed within the channel 27 in the panel 96. The knob 56 abuts an uppermost edge 51 of each of the forward 23 and rearward 25 sides of the panel 96. The knob 56 may be gripped to position the arrow 76 in a deployed position. The arrow 76 extends laterally away and upwardly away from the first lateral side 49 of the panel 96 in the deployed position. Additionally, the arrow 76 directs the observer away from the hazard.

A cylinder 41 is coupled to a second lateral side 39 of the panel 96. A topmost end 90 of the cylinder 41 is directed upwardly from the uppermost edge 51 of the forward 23 and rearward 25 sides of the panel 96. The cylinder 41 may insertably receive the flare 58.

Indicia 86 are printed on a forwardmost surface 43 of the forward side 23 of the panel 96. The indicia 86 comprise the word "Caution". The indicia 86 additionally comprise a diamond with a plurality of stripes positioned on opposite sides of the diamond. Indicia 86 are printed on an onword 45 surface of the arrow 76. The indicia 86 comprise a plurality of intersecting diamonds.

In use, the base 12 is orientable on the support surface 24 so the point 82 of the arrow 76 directs the observer away from the hazard. The base 12 is positioned a suitable distance from the hazard so the observer has enough time to react to the hazard. The assembly 10 is utilized with or without the flare 58. In the alternative embodiment 94, the platform 11 is positioned on the support surface 24 so the arrow 76 directs the observer away from the hazard.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A hazard alert assembly comprising:

a base structured to retain a flare on a support surface such that the flare is visible to an observer;

a frame coupled to said base such that said frame is configured to be visible to the observer wherein said frame alerts the observer to a hazard, said frame comprising a plurality of arms, a pair of diagonal ones of said arms being coupled to and extending upwardly from opposite ends of a horizontal one of said arms, said pair of diagonal ones of said arms intersecting at a point such that said frame has a triangular shape; and an arrow coupled to said frame such that said arrow is configured to indicate a direction the observer should travel to avoid the hazard, said arrow having a primary end and a secondary end, said arrow being elongated between said primary and secondary ends, said arrow being structured such that said primary end of said arrow defines a point of said arrow and said secondary end of said arrow defines a tail of said arrow, said arrow being coupled to said frame such that said arrow intersects each of said diagonal ones of said arms of said frame wherein said primary and secondary ends of said arrow are positioned proximate an associated one of said vertical arms of said frame.

2. The assembly according to claim 1, further comprising said base having a perimeter edge extending between each of a front side and a back side of said base, said base having a first end and a second end, said base being elongated between said first and second ends.

3. The assembly according to claim 2, further comprising said base being positionable on a support surface such that a bottom side of said perimeter edge of said base abuts the support surface.

4. The assembly according to claim 1, further comprising a pair of tubes each having a top end and a bottom end, said top end of said tubes being open such that said tubes are configured to receive the flare.

5. The assembly according to claim 4, further comprising:

said base having a first end, a second end; and a perimeter edge; and said tubes each being coupled to an associated one of said first and second ends of said base such that said top end of said tubes is directed upwardly from a top side of said perimeter edge of said base.

6. The assembly according to claim 1, further comprising:

said base having a perimeter edge; and a lower side of said horizontal arm removably engaging a top side of said perimeter edge of said base such that said horizontal arm of said frame is oriented transversely to said base wherein said diagonal ones of said arms extend upwardly from said base.

7. The assembly according to claim 1, further comprising said assembly being orientable on the support surface such that said point of said arrow directs the observer away from the hazard.

8. A hazard alert assembly comprising:

a base, said base having a perimeter edge extending between each of a front side and a back side of said base, said base having a first end and a second end, said base being elongated between said first and second ends, said base being positionable on a support surface such that a bottom side of said perimeter edge of said base abuts the support surface;

a pair of tubes each having a top end and a bottom end, said top end of said tubes being open such that said tubes are configured to receive a flare, said tubes each being coupled to an associated one of said first and second ends of said base such that said top end of said tubes is directed upwardly from a top side of said perimeter edge of said base wherein the flare is visible to an observer;

a frame, said frame comprising a plurality of arms, a pair of diagonal ones of said arms being coupled to and extending upwardly from opposite ends of a horizontal one of said arms, said pair of diagonal ones of said arms intersecting at a point such that said frame has a triangular shape;

a lower side of said horizontal arm removably engaging a top side of said perimeter edge of said base such that said horizontal arm of said frame is oriented transversely to said base, said diagonal ones of said arms extending upwardly from said base such that said frame is configured to be visible to the observer wherein said frame alerts the observer to a hazard; and an arrow, said arrow having a primary end and a secondary end, said arrow being elongated between said primary and secondary ends, said arrow being structured such that said primary end of said arrow defines a point of said arrow and said secondary end of said arrow defines a tail of said arrow; and said arrow being coupled to said frame such that said arrow intersects each of said diagonal ones of said arms of said frame wherein said primary and secondary ends of said arrow are positioned proximate an associated one of said diagonal ones of said arms of said frame, said assembly being orientable on the support surface such that said point of said arrow directs the observer away from the hazard.

* * * * *